US010123627B2

(12) United States Patent
King et al.

(10) Patent No.: US 10,123,627 B2
(45) Date of Patent: Nov. 13, 2018

(54) ARTICLE OF FURNITURE

(71) Applicant: King Furniture Australia Pty Ltd., Turrella (AU)

(72) Inventors: David King, Turrella (AU); John Levey, Turrella (AU); Ryan Lawson, Turrella (AU); Anastasie Panagopoulos, Turella (AU); Tanya Rechberger, Turrella (AU)

(73) Assignee: King Furniture Australia Pty Ltd., Turrella (AU)

( * ) Notice: Subject to any disclaimer, the term of this patent is extended or adjusted under 35 U.S.C. 154(b) by 0 days.

(21) Appl. No.: 15/513,186

(22) PCT Filed: Aug. 7, 2015

(86) PCT No.: PCT/AU2015/050449
§ 371 (c)(1),
(2) Date: Mar. 22, 2017

(87) PCT Pub. No.: WO2016/044885
PCT Pub. Date: Mar. 31, 2016

(65) Prior Publication Data

US 2017/0303690 A1 Oct. 26, 2017

(30) Foreign Application Priority Data

Sep. 25, 2014 (AU) ..... 2014903826

(51) Int. Cl.
*A47B 83/02* (2006.01)
*A47C 7/62* (2006.01)
(Continued)

(52) U.S. Cl.
CPC ..... *A47C 7/62* (2013.01); *A47C 7/38* (2013.01); *A47C 7/40* (2013.01); *A47C 7/50* (2013.01);
(Continued)

(58) Field of Classification Search
CPC .... A47C 7/62; A47C 7/38; A47C 7/40; A47C 7/50; A47C 7/54; A47C 7/725; A47C 17/86
(Continued)

(56) References Cited

U.S. PATENT DOCUMENTS 1,189,835 A * 7/1916 Labadie et al. ..... B60N 3/004 297/163 X
1,337,886 A * 4/1920 Debakey ..... A47B 5/04 297/163 X
(Continued)

FOREIGN PATENT DOCUMENTS

CN 202999986 U 6/2013

OTHER PUBLICATIONS

Oct. 19, 2015—International Serach Report and Written Opinion—PCT/AU2015/050449.

*Primary Examiner* — Rodney B White
(74) *Attorney, Agent, or Firm* — Banner & Witcoff, Ltd.

(57) ABSTRACT

A rest component (12, 14) for an article of furniture (10) includes a body member (16) mountable to a platform (18) of the article of furniture (10), the body member (16) defining a plurality of surfaces (20). A cover member (26) is carried by the body member (16) to define a pocket (32) associated with at least one surface (20) of the body member (16), the pocket (32) defining a mouth (34) to enable a user to gain access to an interior of the pocket (32). At least one receiving formation (36) is carried by the body member (16) within the pocket (32), the cover member (26) concealing the at least one receiving formation (36).

24 Claims, 2 Drawing Sheets

(51) Int. Cl.

| | |
|---|---|
| ***A47C 7/68*** | (2006.01) |
| ***A47C 7/38*** | (2006.01) |
| ***A47C 7/50*** | (2006.01) |
| ***A47C 7/54*** | (2006.01) |
| ***A47C 7/40*** | (2006.01) |
| ***A47C 17/86*** | (2006.01) |
| ***A47C 7/72*** | (2006.01) |

(52) U.S. Cl.
CPC ..... *A47C 7/54* (2013.01); *A47C 7/725* (2013.01); *A47C 17/86* (2013.01)

(58) Field of Classification Search
USPC ..... 297/135, 146, 147, 170, 188.01–188.13
See application file for complete search history.

(56) References Cited

U.S. PATENT DOCUMENTS 2,015,976 A * 10/1935 Trepte ..... A47B 5/02 297/163 X
2,184,047 A * 12/1939 King ..... B60N 3/004 297/163 X
2,229,937 A 1/1941 Reese
2,963,078 A * 12/1960 Ferrelle ..... B60N 3/004 297/146 X
3,583,760 A * 6/1971 McGregor ..... A47B 5/006 297/145
3,632,161 A * 1/1972 Arfaras ..... A47C 7/70 297/145
4,925,256 A * 5/1990 Vargas ..... A47B 27/02 297/163
5,004,295 A * 4/1991 Inoue ..... B60N 2/70 297/188.07
5,423,597 A * 6/1995 Rogers ..... A47B 39/00 297/135
5,620,229 A * 4/1997 Ledford ..... A47C 1/143 297/188.04 X
5,803,326 A * 9/1998 Krieger ..... B60R 7/04 297/135 X
5,820,210 A * 10/1998 Shipman ..... A47C 7/62 297/188.01
6,053,570 A * 4/2000 Stern ..... A47C 7/62 297/188.01 X
6,079,773 A * 6/2000 Hassan ..... B60N 2/90 297/188.13
6,082,816 A 7/2000 Gottlieb et al.
6,131,993 A * 10/2000 Pesta ..... B60R 7/043 297/188.04 X
6,607,241 B2 * 8/2003 Johnston ..... B60N 2/20 297/188.06
8,141,948 B2 * 3/2012 Cassellia ..... B60K 35/00 297/188.04
8,434,415 B1 * 5/2013 Federici ..... A47C 7/62 297/146 X
8,596,206 B2 * 12/2013 Legeay ..... B60N 3/002 297/145 X
8,944,379 B2 * 2/2015 Orson ..... B64D 11/06 244/118.6
8,979,189 B2 * 3/2015 Henshaw ..... A47B 83/02 297/135
9,150,129 B2 * 10/2015 Suhre ..... B60N 2/4606
9,609,946 B2 * 4/2017 Gow ..... A47B 5/006
9,815,556 B2 * 11/2017 Helwig ..... B64D 11/0638
2004/0026966 A1 * 2/2004 Albersen ..... B60N 2/6081 297/188.06
2005/0110310 A1 * 5/2005 Mayer ..... B60N 2/686 297/188.06
2005/0248189 A1 * 11/2005 Prasatek ..... B60N 2/64 297/188.04
2006/0006705 A1 1/2006 Charbonneau
2009/0001775 A1 * 1/2009 Smith ..... A47B 83/02 297/135
2010/0231009 A1 * 9/2010 Chi ..... A47C 7/407 297/135 X
2010/0244506 A1 * 9/2010 Terleski ..... B64D 11/06 297/188.05
2011/0156450 A1 * 6/2011 Collins ..... B60N 3/002 297/135
2011/0169306 A1 * 7/2011 Thompson ..... B64D 11/02 297/147
2011/0198896 A1 * 8/2011 Brinster ..... B60R 7/005 297/188.06
2012/0133180 A1 * 5/2012 Moulton ..... B64D 11/06 297/135
2013/0076082 A1 * 3/2013 Herault ..... B60N 2/00 297/135 X
2013/0313866 A1 * 11/2013 Dryburgh ..... A47C 1/0352 297/135 X
2014/0042781 A1 * 2/2014 Reeves ..... B60N 3/004 297/163
2014/0062147 A1 * 3/2014 Bashir ..... B60R 7/005 297/188.01
2014/0159440 A1 * 6/2014 Porter ..... B60N 2/01 297/163
2014/0175842 A1 * 6/2014 Headrick ..... B64D 11/007 297/135 X
2014/0300146 A1 * 10/2014 Thisius ..... B64D 11/00 297/135
2015/0284089 A1 * 10/2015 Gow ..... B64D 11/0605 297/147
2015/0321592 A1 * 11/2015 De Morais ..... B64D 11/06 297/147
2016/0007746 A1 * 1/2016 Sock ..... A47B 83/04 297/163
2016/0375810 A1 * 12/2016 Kong ..... B60N 2/793 297/145
2016/0375834 A1 * 12/2016 Lemarchand ..... B60N 2/58 297/188.01

* cited by examiner

ARTICLE OF FURNITURE

CROSS-REFERENCE TO RELATED APPLICATIONS

This application is a U.S. National Stage application under 35 U.S.C. § 371 of International Application PCT/AU2015/050449 (published as WO 2016/044885 A1), filed Aug. 7, 2015, which claims the benefit of priority to AU 2014903826, filed Sep. 25, 2014, each of which are hereby incorporated by reference in their entireties.

TECHNICAL FIELD

This disclosure relates, generally, to furniture and, more particularly, to a rest component for an article of furniture and to a furniture system including the rest component.

BACKGROUND

It is becoming increasingly popular to use articles of furniture having extensible portions such as, for example, extensible seat bases, footrests, or the like. This can create problems in placing tables or other items in front of the article of furniture since extension of the seat base or footrest, as the case may be, would be impeded by such table or other item.

Still further, dwellings and their rooms are becoming increasingly more compact reducing the space available for arranging accessories such as side tables, lamps, etc.

Also, the location of accessories such as tables, lamps, speakers, etc. alongside the articles of furniture makes it difficult to clean around the articles of furniture.

SUMMARY

In a first aspect, there is provided a rest component for an article of furniture, the component including a body member mountable to a platform of the article of furniture, the body member defining a plurality of surfaces;

a cover member carried by the body member to define a pocket associated with at least one surface of the body member, the pocket defining a mouth to enable a user to gain access to an interior of the pocket; and at least one receiving formation carried by the body member within the pocket, the cover member concealing the at least one receiving formation.

The term "rest" is to be understood to include an armrest or a backrest of the article of furniture. In certain circumstances, the "rest" may also be a suitably configured seat, headrest or footrest of the article of furniture.

By "associated with at least one surface of the body member" is meant simply that the pocket is positioned adjacent that surface of the body member irrespective of which parts of the body member and/or cover member define the pocket.

The cover member may cover substantially an entire surface of the operatively outer side of the body member, the mouth of the pocket being positioned proximate an upper edge of the outer side of the body member. By "proximate" is meant that the mouth of the pocket is located below the upper edge of the outer side of the body member. However, the term is intended also to include an embodiment where the mouth is positioned at the upper edge of the outer side of the body member.

The pocket may have a bottom which is spaced from an operatively lower edge of the cover member. In an embodiment, the bottom of the pocket is arranged closer to the mouth of the pocket than to the lower edge of the cover member.

The component may include a plurality of receiving formations arranged within the pocket. The receiving formations may be arranged at spaced intervals within the pocket.

The at least one receiving formation may comprise a knock-in defining a bore. The knock-in may be of a suitable synthetic plastics material.

The cover member may be of a multi-layer of construction, the pocket being defined between layers of the cover member. For example, the pocket may be defined between inner layers of the cover member.

The component may include a retaining arrangement for retaining the cover member in a closed position relative to the body member to close off the pocket. The retaining arrangement may be a magnetic retaining arrangement, the body member carrying at least one magnetic element covered by a first, inner layer of the cover member and an outer layer of the cover member carrying at least one magnetic member which magnetically engages the magnetic element.

The at least one magnetic element and the at least one magnetic member may be concealed within the body member and the cover member, respectively. In an embodiment, the retaining arrangement may comprise a plurality of spaced magnetic elements arranged within the body member with the magnetic member being a strip of a magnetic material arranged within the cover member adjacent the mouth of the pocket. The strip may be sewn into a seam running alongside the mouth of the cover member.

In other embodiments, the cover member may be a single layer construction with the pocket being formed between a layer of the body member defining the surface and the layer of the cover member.

In an embodiment, the at least one receiving formation may be located between the body member and the cover member to be concealed by the cover member.

In a second aspect, there is provided a rest component for an article of furniture, the component including a body member mountable to a platform of the article of furniture, the body member defining a plurality of surfaces;

a cover member carried by the body member to define a pocket associated with at least one surface of the body member, the pocket defining a mouth to enable a user to gain access to an interior of the pocket; and a retaining arrangement for retaining the cover member in a closed position relative to the body member to close off the pocket.

In a third aspect, there is provided a rest component for an article of furniture, the component including a body member mountable to a platform of the article of furniture, the body member defining a plurality of surfaces; and a cover member carried by the body member to define a pocket associated with at least one surface of the body member, the pocket defining a mouth to enable a user to gain access to an interior of the pocket; and in which the pocket has a bottom which is spaced from an operatively lower edge of the cover member.

In a fourth aspect, there is provided a furniture system which includes at least one rest component as described above with reference to the first aspect;

a carrier removably receivable in the at least one receiving formation of the component, the carrier having a portion which, in use, projects through the mouth of the pocket of the at least one component; and an accessory mountable on the portion of the carrier.

The carrier may be in the form of a bracket. The bracket may be shaped to follow contours of the body member. In an embodiment, the bracket may be stepped to follow the contours of the body member. Further, an end of the bracket to be inserted into the receiving formation may be shaped to facilitate insertion into the receiving formation. The end of the bracket may be tapered to facilitate insertion into the receiving formation.

The system may include a bracket associated with each receiving formation, each bracket, when used, mounting an accessory.

The system may include a plurality of accessories, the accessories comprising at least a lighting unit, a sound unit, a table (with or without a battery charging unit), a shelf and illumination arrangement.

In the case of the speaker unit, such a speaker unit may be a commercially available unit forming part of a surround-sound audio system. The system of the disclosure may therefore include an adapter for mounting the sound unit to its associated bracket.

The shelf may have a cutaway portion along its operatively inner edge so that, when the shelf is mounted to the body member of the component, access can still be gained to an interior of the pocket via the mouth of the pocket.

The system may include a battery charging unit located within the pocket of the component. The battery charging unit received in the pocket may be a wireless battery charging unit and may be located in a concealed location within the pocket, i.e. behind fabric or material covering the body member.

The illumination arrangement may be mounted directly or indirectly to the component to illuminate a region below the component. The system may include a platform on which the component is mounted, the illumination arrangement being attached to a part of the platform.

At least the part of the platform may be covered with a fabric suitable for use as a component of a hook-and-loop securing system. The illumination arrangement may comprise a plurality of light emitting elements, for example, light emitting diodes (LEDs), suspended from a strip of a material complementary to the fabric used for covering the platform, the strip, in use, engaging the fabric of the platform hook-and-loop fashion.

In a fifth aspect, there is provided a rest component for an article of furniture, the component including a body member; and a battery charging unit located within the body member.

The component may include a cover member carried by the body member to define a pocket associated with a surface of the body member, the pocket defining a mouth to enable a user to gain access to an interior of the pocket. The battery charging unit may be located behind the cover member to be operatively accessible via the pocket.

By "operatively accessible" is meant that the battery charging unit is able to couple wirelessly with the device to be charged by the battery charging unit when the device is placed in the pocket in sufficiently close proximity to the battery charging unit.

BRIEF DESCRIPTION OF DRAWINGS

Embodiments of the disclosure are now described by way of example with reference to the accompanying diagrammatic drawings in which:—

DETAILED DESCRIPTION OF EXEMPLARY EMBODIMENTS

Figure 1:
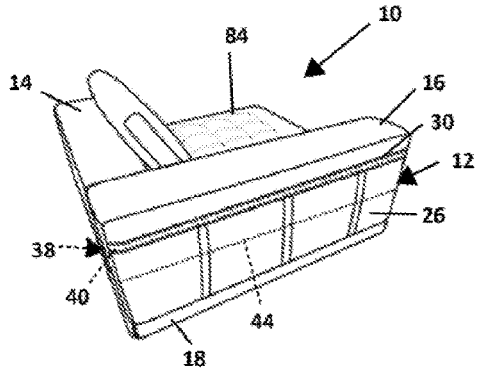
FIG. 1 shows a perspective view of an article of furniture including an embodiment of a rest component.

In the drawings, reference numeral 10 generally designates an article of furniture including an embodiment of a rest component 12. As defined, the rest component 12 is either a backrest or an armrest of the article of furniture 10 but it could also be an appropriately configured seat, headrest or footrest of the article of furniture 10. In the illustrated embodiment, the rest component 12 is an armrest and will be described with reference to that application below.

The article of furniture 10, which, in the described embodiment, is in the form of a chaise, includes a backrest 14. It will be appreciated that the backrest 14 is configured similarly to the armrest 12.

As indicated, in the described embodiment, the illustrated article of furniture 10 is in the form of a chaise but the article of furniture could be a sofa, an armchair, or the like. For ease of explanation and brevity, the article of furniture 10 will be referred to as a chaise 10 in the following description.

Figure 4:
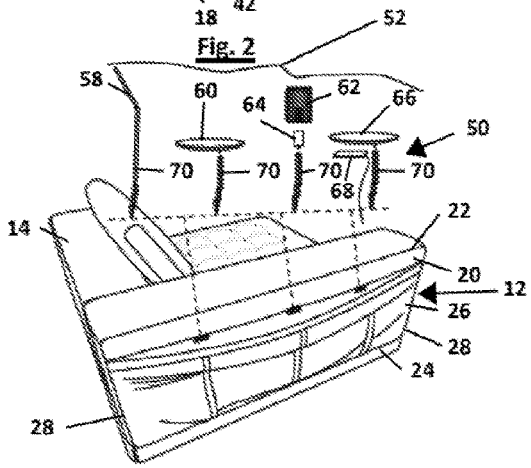
FIG. 4 shows a perspective view of an embodiment of a furniture system.

The armrest 12 includes a body member 16 mountable to a platform 18. The body member 16 defines a plurality of surfaces or sides including an operatively outer surface or side 20. In addition, the outer side 20 has an operatively upper edge 22 and an operatively lower edge 24 (FIG. 4).

The body member 16 is a box-like structure having a box frame (not shown) covered by upholstery including foam padding and, in this embodiment, a fabric or leather covering.

The armrest 12 includes a cover member 26 carried by the operatively outer side 20 of the body member 16. In an embodiment, the cover member 26 is of the same fabric or leather as the covering of the body member 16 but, in other embodiments, the cover member 26 could be of a different material and/or a different colour than that of the covering of the body member 16. A periphery of the cover member 26 is generally in register with the operatively lower edge 24 and opposed side edges 28 of the body member 16. An operatively upper edge 30 (FIG. 1) of the cover member 26 terminates operatively below the upper edge 22 of the body member 16.

In another embodiment, the cover member 26 covers the entire body member 16 in which case the covering of the body member 16 may be omitted.

Figure 3:
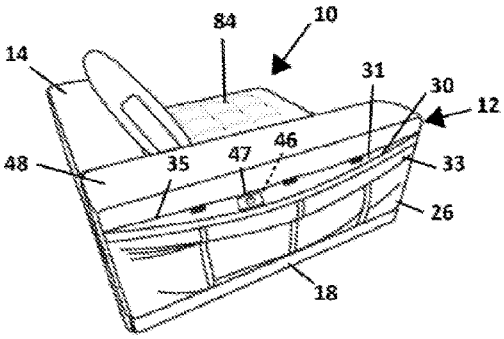
FIG. 3 shows a perspective view of the article of furniture with another embodiment of the rest component with the pocket of the rest component in an open configuration.

The cover member 26 is of a multi-layered construction having at least an inner layer 31 and an outer layer 33 (FIG. 3). A pocket 32 is defined between the inner layer 31 and the outer layer 33 of the cover member 26. The pocket 32 defines a mouth 34 to enable a user to gain access to an interior of the pocket 32. The mouth 34 is defined by the operatively upper edge 30 of the outer layer 33 and the corresponding operatively upper edge 35 of the inner layer 31 of the cover member 26. Hence, the mouth 34 of the pocket 32 is arranged operatively below the upper edge 22 of the outer side 20 of the body member 16. In another embodiment, not shown, the mouth 34 of the pocket 32 could be in register with the operatively upper edge 22 of the body member 16.

The armrest 12 includes a plurality of receiving formations 36 arranged in spaced relationship in the pocket 32, the receiving formations 36 being arranged in the outer side 20 of the body member 16 at a level operatively below the upper edges 30 and 35 of the cover member 26 to be concealed by the cover member 26 when the mouth 34 of the pocket 32 is closed.

Each receiving formation 36 is in the form of a knock-in of a suitable synthetic plastics material. The plastics material may be of a type incorporating a lubricant to facilitate insertion of a component within the knock-in 36. Each knock-in 36 defines a bore within which a part of the component is received, in use, the bore being surrounded by a flared collar to guide the component into the bore. Each knock-in 36 is inserted into the body member through an opening (not shown) in the inner layer 31 of the cover member 26.

In another embodiment, each knock-in 36 is located behind the inner layer 31 of the cover member 26 and is accessed through an opening (not shown) in the inner layer 31 of the cover member 26. Thus, in contrast to the illustrated embodiment, each knock-in 36 is concealed by the inner layer 31 of the cover member 16 rather than being visible as illustrated.

The armrest 12 includes a retaining arrangement 38 (FIG. 1) for retaining the cover member 26 in a closed position relative to the outer side 20 of the body member 16 of the armrest 12. By "closed position" is meant that the mouth 34 of the pocket 32 is closed so that the upper edges 30 and 35 of the cover member 26 are substantially in contact with each other.

Figure 2:
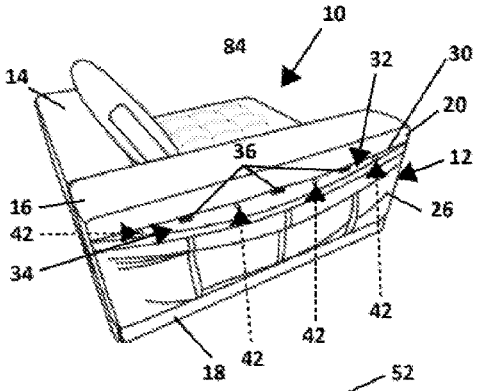
FIG. 2 shows a perspective view of the article of furniture with a pocket of the rest component in an open configuration.

The retaining arrangement 38 comprises a strip 40 of a magnetic material arranged in the outer layer 33 of the cover member 26 below the upper edge 30 of the outer layer 33 of the cover member 26 and extending parallel to the upper edge 30 of the outer layer 33 of the cover member 26. The retaining arrangement 38 further includes a plurality of spaced magnetic, substantially button-shaped elements 42 (FIG. 2) arranged at spaced intervals on the body member 16 within the pocket 32. The magnetic elements 42 are concealed behind the covering of the body member 16 on the outer side 20 of the body member 16 and also behind the inner layer 31 of the cover member 26.

The inner layer 31 and the outer layer 33 of the cover member 26 are sewn together along a seam 44 (FIG. 1). This seam 44 extends parallel to the upper edges 30 and 35 of the covering member 26 and forms a bottom of the pocket 32. The seam 44 is positioned closer to the upper edges 30 and 35 of the covering member 26 than to the lower edge 24 of the body member 16 and, hence, the covering member 26. The seam 44 is positioned so that easy access can be gained by an occupant of the chaise 10 to items stored in the pocket 32, i.e. the depth of the pocket 32 is defined so that an occupant of the chaise 10 can reach an item in the pocket 32 while seated on the chaise 10 without difficulty.

Referring to FIG. 3 of the drawings, a further embodiment of the armrest 12 is illustrated. With reference to the other drawings, like reference numerals refer to like parts unless otherwise specified.

In this embodiment, the armrest 12 includes a battery charging unit 46 built into the body member 16. The battery charging unit 46 is a wireless battery charging unit and is located in the body member 16 behind the covering of the body member 16. In the illustrated embodiment, the battery charging unit 46 is located behind the covering of the body member 16 in a region of the pocket 32 to be operatively accessible via the pocket 32. However, it will be appreciated that the battery charging unit 46 could be located in any other suitable position on the armrest 12 such as, for example, below a top surface 48 of the armrest 12.

An indicium 47, such as a label, may be affixed to an outer surface of the covering of the body member 16 so that a user knows where the battery charging unit 46 is located.

Figure 5:
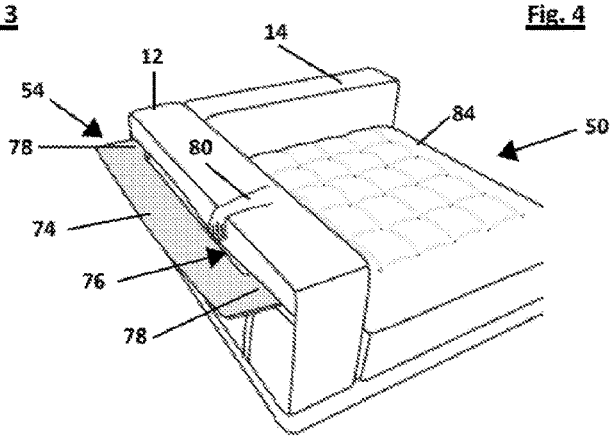
FIG. 5 shows a perspective view of another embodiment of the furniture system.
Figure 6:
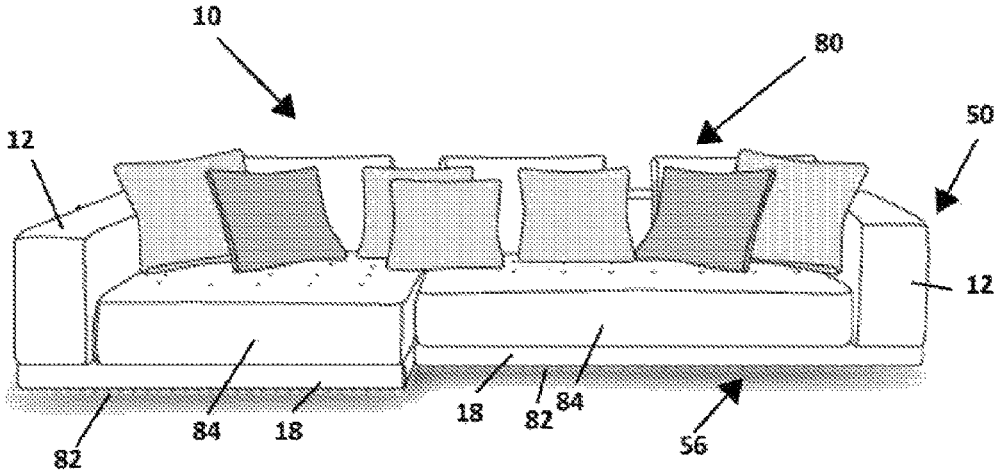
FIG. 6 shows a perspective front view of yet a further embodiment of the furniture system.

Referring now to FIGS. 4-6 of the drawings, an embodiment of a furniture system 50 is described in greater detail. The furniture system 50 includes the article of furniture which, in the illustrated embodiment, is the chaise 10 having the described embodiment of the armrest 12.

The system 50 includes a plurality of accessories, a first group of accessories being labelled 52 in FIG. 4 of the drawings, a further accessory being labelled 54 in FIG. 5 of the drawings and still a further accessory being labelled 56 in FIG. 6 of the drawings.

The group of accessories 52 includes a lamp 58, a table 60, a surround-sound speaker 62 with an adapter 64 and a charging table 66 incorporating a wireless battery charging unit 68. This is a non-exhaustive list of the accessories comprising the group of accessories 52 and other accessories which could be attached to the armrest 12 will be readily apparent to one of ordinary skill in the art.

The system 50 includes a carrier in the form of a bracket 70 associated with each accessory of the group of accessories 52. The bracket 70 is shaped to follow the contours of the body member 16 of the armrest 12 to hug the outer side 20 of the body member 16 as closely as possible. In particular, the bracket 70 is stepped in order to follow the contours of the body member 16. It also ensures that the strip 40 of magnetic material of the cover member 26 sits snugly and smoothly against the outer side 20 of the body member 16.

That end of each bracket 70 to be inserted into the bore of its associated knock-in 36 is tapered to facilitate insertion into the bore of the knock-in 36.

It will be appreciated that as many of the accessories of the group 52 as desired may be used together, the only limitation being the number of knock-ins 36 provided in the body member 16 of the armrest 12. Thus, for example, the lamp 58 could be used together with a speaker 62 and a table 60 or 66.

With reference to the tables 60 and 66, the only difference is the use of the wireless battery charging unit 68 in association with the table 66. The battery charging unit 68 is similar to the charging unit 46 and charges the battery of a device by being wirelessly coupled to the device.

In the case of the table 66, the charging unit 68 is arranged below, or within, the table 66 to be positioned below a top surface of the table 66. The charging unit 68 is connected via an electrical lead 72 to a source of power (not shown). In use, when an occupant of the chaise 10 wishes to charge his or her device, the device, assuming it has the necessary coupling unit to couple wirelessly with the charging unit 68, is simply placed on an upper surface of the table 66 to be charged.

In the case of the speaker 62, the speaker 62 is a commercially available speaker used in typical surround-sound systems. To mount the relevant speaker 62 on its associated bracket 70, the system 50 includes the adapter 64.

In FIG. 5 of the drawings, the accessory 54 is in the form of a shelf 74. The shelf 74 is attached to the armrest 12 via the use of two, spaced L-shaped brackets (not shown). An operatively inner edge of the shelf 74 defines a cutaway portion 76 with a pair of spaced extensions 78 at opposite ends of the cutaway portion 76. The shelf 74 is mounted to the armrest 12 via the L-shaped brackets being attached, optionally removably, to the extensions 78.

The cutaway portion 76 of the shelf 74 enables the occupant to gain access to the interior of the pocket 32 through the mouth 34 of the pocket 32. This is shown schematically by the occupant's hand 80 in FIG. 5 of the drawings. The upper edge 30 of the covering member 26 serves to cushion the occupant's hand 80 against the hard surface of the shelf 74.

In FIG. 6 of the drawings, a further furniture system 50 is illustrated. Once again, with reference to the previous drawings, like reference numerals refer to like parts unless otherwise specified.

In this embodiment, the illustrated furniture system 50 includes the chaise 10 as well as a 2 seater sofa 80 arranged alongside the chaise 10. The sofa 80 is similarly configured to the chaise 10 including the platform 18, armrest 12 and a backrest 14. In this embodiment, the accessory 56 comprises an illumination arrangement 82, for example, in the form of a series of light emitting diodes (LEDs) mounted to an under surface of the platform 18 of each of the chaise 10 and the sofa 80.

The LEDs of the illumination arrangement 80 are carried on a strip of material (not shown). This strip of material functions as a first component of a hook-and-loop securing system. At least a part of each platform 18 is covered with a tricot fabric which functions as a second component of the hook-and-loop securing system. Thus, the strip of material carrying the LEDs is merely stuck to the tricot fabric to be held in position. It will be appreciated that other securing systems could be used instead such as, for example, a press-stud arrangement, a zip arrangement, or the like.

In some embodiments, a strip carrying the LEDs may be mounted on an L-shaped mounting bracket (not shown) which is attached, for example, to a vertical surface of the platform 18, either using a hook-and-loop securing system or any other suitable securing system.

In use, the illumination arrangement 80 is connected to a source of power (not shown). When energised, the LEDs of the illumination arrangement 80 provide mood lighting to a room containing the furniture system 50. The illumination arrangement 80 further provides the appearance that the furniture system 50 is "floating" relative to a substrate supporting the furniture system 50.

It is an advantage of the disclosure that a rest component for an article of furniture is provided which lends itself for use with articles of furniture having extensible seat bases 84. Further, it is an advantage of the disclosure that the furniture system 50 incorporating the rest component provides a compact installation including accessories such as lamps, tables, or the like, which is beneficial where space is at a premium.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A rest component for an article of furniture, the rest component comprising:

a body member mountable to a platform of the article of furniture, the body member defining a plurality of surfaces;

a cover member carried by the body member to define a pocket associated with at least one surface of the body member, the pocket defining a mouth to enable a user to gain access to an interior of the pocket, wherein at least a part of the cover member comprises a multi-layered construction, and wherein the pocket is defined between layers of the cover member; and at least one receiving formation carried by the body member within the pocket, the cover member concealing the at least one receiving formation.

2. The rest component of claim 1, wherein the cover member covers substantially an entire surface of an operatively outer side of the body member, the mouth of the pocket being positioned proximate to an upper edge of the operatively outer side of the body member.

3. The rest component of claim 2, wherein the pocket includes a bottom spaced from an operatively lower edge of the cover member.

4. The rest component of claim 1, wherein the at least one receiving formation includes a plurality of receiving formations arranged within the pocket.

5. The rest component of claim 1, wherein the at least one receiving formation comprises a knock-in defining a bore.

6. The rest component of claim 1, further comprising a retaining arrangement configured to retain the cover member in a closed position relative to the body member to close off the pocket.

7. The rest component of claim 6, wherein the retaining arrangement comprises a magnetic retaining arrangement, wherein the body member carries at least one magnetic element covered by a first, inner layer of the cover member and wherein an outer layer of the cover member carries at least one magnetic member which magnetically engages the at least one magnetic element.

8. The rest component of claim 7, wherein the at least one magnetic element is concealed within the body member, and wherein the at least one magnetic member is concealed within the cover member.

9. The rest component of claim 1, wherein the at least one receiving formation is located between the body member and the cover member so as to be concealed by the cover member.

10. A rest component for an article of furniture, the rest component comprising:

a body member mountable to a platform of the article of furniture, the body member defining a plurality of surfaces;

a cover member carried by the body member to define a pocket associated with at least one surface of the body member, the pocket defining a mouth to enable a user to gain access to an interior of the pocket, wherein at least a part of the cover member comprises a multi-layered construction, and wherein the pocket is defined between layers of the cover member; and a retaining arrangement for retaining the cover member in a closed position relative to the body member to close off the pocket.

11. A rest component for an article of furniture, the rest component comprising:

a body member mountable to a platform of the article of furniture, the body member defining a plurality of surfaces; and a cover member carried by the body member to define a pocket associated with at least one surface of the body member, the pocket defining a mouth to enable a user to gain access to an interior of the pocket, wherein the pocket includes a bottom spaced from an operatively lower edge of the cover member, wherein at least a part of the cover member comprises a multi-layered construction, and wherein the pocket is defined between layers of the cover member.

12. A furniture system comprising:

at least one rest component as claimed in claim 1;

a carrier removably receivable in the at least one receiving formation of the rest component, the carrier including a portion which, when in a use position, projects through the mouth of the pocket of the at least one rest component; and an accessory mountable on the portion of the carrier.

13. The furniture system of claim 12, wherein the carrier comprises a bracket.

14. The furniture system of claim 13, wherein the bracket is shaped to follow contours of the body member.

15. The furniture system of claim 14, wherein an end of the bracket is configured to be inserted into the at least one receiving formation and is shaped to facilitate insertion into the at least one receiving formation.

16. The furniture system of claim 12, further comprising a bracket associated with the at least one receiving formation, wherein the bracket is configured to mount an accessory.

17. The furniture system of claim 12, further comprising a plurality of accessories, wherein the plurality of accessories include a lighting unit, a sound unit, a table, a shelf, and an illumination arrangement.

18. The furniture system of claim 17, wherein the shelf includes a cutaway portion along an operatively inner edge so that, when the shelf is mounted to the body member of the at least one rest component, an interior of the pocket is accessible via the mouth of the pocket.

19. The furniture system of claim 12, further comprising a battery charging unit located within the pocket of the at least one rest component.

20. The furniture system of claim 12, further comprising an illumination arrangement mounted to the at least one rest component and configured to illuminate a region below the at least one rest component.

21. The furniture system of claim 20, further comprising the platform on which the body member of the at least one rest component is mounted, wherein the illumination arrangement is attached to a part of the platform.

22. A rest component for an article of furniture, the rest component comprising:

a body member;

a cover member carried by the body member to define a pocket associated with a surface of the body member, the pocket defining a mouth to enable a user to gain access to an interior of the pocket, wherein at least a part of the cover member comprises a multi-layered construction, and wherein the pocket is defined between layers of the cover member; and a battery charging unit located within the body member.

23. The rest component of claim 22, further comprising at least one receiving formation carried by the body member within the pocket, the cover member concealing the at least one receiving formation.

24. The rest component of claim 23, wherein the battery charging unit is located behind the cover member to be operatively accessible via the pocket.

* * * * *